US011186472B2

(12) United States Patent
Cutaio et al.

(10) Patent No.: US 11,186,472 B2
(45) Date of Patent: Nov. 30, 2021

(54) CAPPING HEAD, SYSTEM AND METHOD

(71) Applicant: PELLICONI & C. S.P.A., Ozzano Dell'Emilia (IT)

(72) Inventors: Francesco Cutaio, Toscanella di Dozza (IT); Federico Morselli, Bologna (IT); Doriano Naldi, Ozzano Dell'Emilia (IT)

(73) Assignee: PELLICONI & C. S.P.A., Ozzano Dell'Emilia (IT)

( * ) Notice: Subject to any disclaimer, the term of this patent is extended or adjusted under 35 U.S.C. 154(b) by 0 days.

(21) Appl. No.: 17/026,952

(22) Filed: Sep. 21, 2020

(65) Prior Publication Data

US 2021/0087036 A1 Mar. 25, 2021

(30) Foreign Application Priority Data

Sep. 25, 2019 (IT) ..... 102019000017237

(51) Int. Cl.
*B67B 3/00* (2006.01)
*B67B 3/14* (2006.01)

(52) U.S. Cl.
CPC ..... *B67B 3/14* (2013.01)

(58) Field of Classification Search
CPC .... B67B 3/00; B67B 3/02; B67B 3/10; B67B 3/12; B67B 3/14; B67B 3/16; B67B 3/18; B65B 7/28
USPC ..... 53/488
See application file for complete search history.

(56) References Cited

U.S. PATENT DOCUMENTS 2,670,118 A * 2/1954 Young ..... B65B 7/28 53/351
2,765,600 A * 10/1956 Young ..... B65D 41/06 53/488
3,597,896 A * 8/1971 Koll ..... B67B 3/14 53/488
4,173,104 A 11/1979 Koll
4,621,481 A * 11/1986 Magnusson ..... B67B 3/14 53/345
9,745,183 B2 * 8/2017 Jakob ..... B67B 3/2033

FOREIGN PATENT DOCUMENTS

GB 1140523 A * 1/1969 ..... B65B 7/28
GB 1140523 A 1/1969
JP H04109099 A 4/1992

OTHER PUBLICATIONS

Italian Search Report dated Jun. 15, 2020 from counterpart Italian Application No. IT201900017237.

* cited by examiner

*Primary Examiner* — Chelsea E Stinson
(74) *Attorney, Agent, or Firm* — Shuttleworth & Ingersoll, PLC; Timothy Klima

(57) ABSTRACT

Described is a capping head for closing a container using a metallic cap, comprising a main body, a plurality of capping ends having on their inner face a capping profile and a capping ring configured for elastically deforming the plurality of capping ends by means of a relative translation along the longitudinal axis.

11 Claims, 4 Drawing Sheets

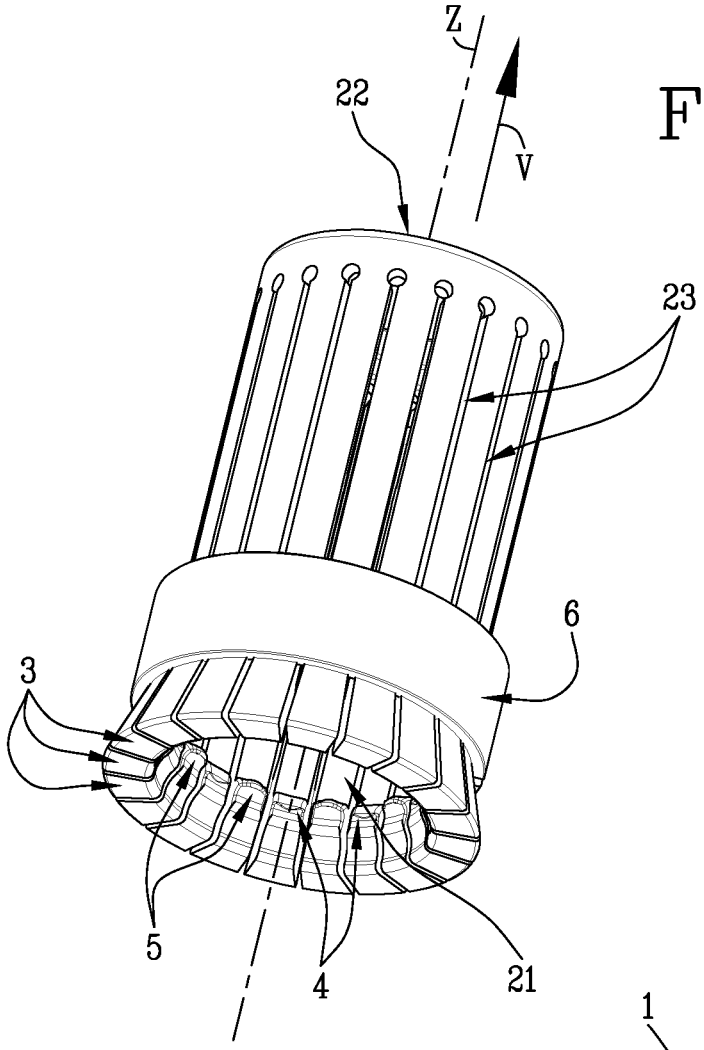
Fig.1
Fig.2
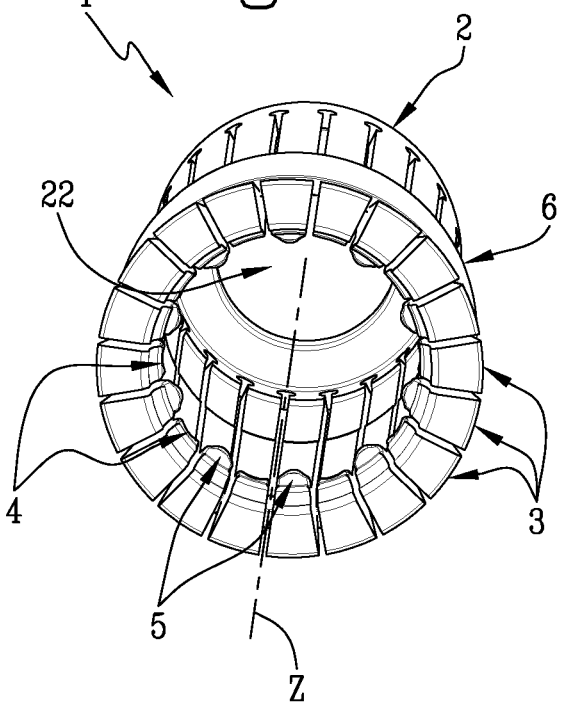

CAPPING HEAD, SYSTEM AND METHOD

This application claims priority to Italian Application 102019000017237 filed Sep. 25, 2019, the entirety of which is incorporated by reference herein.

BACKGROUND OF THE INVENTION

This invention relates to a capping head for deforming by pressure a cap to be applied to a container, for example a glass bottle.

The context of the invention is that of the caps which, once applied to the container, are removed by using a tool, for example a bottle opener, which is able to transfer to the cap the force applied by a user using a system of levers.

The invention also relates to a capping system, comprising the capping head, and a capping method for applying a cap to said container.

SUMMARY OF THE INVENTION

The capping head according to the invention may be used for closing containers designed to contain pressurized liquid products.

The pressurized liquid products present in the containers closed with the capping system and method according to the invention comprise any liquid, for example, carbonated non-alcoholic beverages or beer.

The cap according to the invention is particularly, not exclusively, suitable for closing glass bottles.

The presence of a high pressure liquid inside it means that the cap configured to keep the container closed has particularly high sealing characteristics, so as to prevent the dispersion into the surrounding environment of the gases present in the pressurized liquid.

Currently, one of the most commonly used methods for closing glass bottles containing pressurized liquids involves the so-called "crown" caps.

This type of cap comprises a capsule, generally made of metallic material (for example steel or aluminium), provided with a central part of larger extension and a lateral wall or skirt which extends about a longitudinal axis of the container (or circular axis of symmetry of the cap).

The crown caps are characterized in that they have, before and after the application to the glass bottle to be closed, an almost homogeneous sequence of peaks and grooves in the distal part of said side wall relative to the central part.

Generally speaking, in the inner part of the capsule the crown caps have a plastic seal designed to guarantee the hermetic closing of the bottle and prevent even minimal escape of the gas present in the pressurized liquid.

Thanks to these features, the caps guarantee high levels of efficiency with regard to the seal of the closure even when the pressure inside the container is high.

Whilst guaranteeing a quality of the closure sufficient to comply with the standards imposed by the market, the crown caps have a safety problem linked to the lower profile of the side wall.

The particular shape of the side wall with the alternating of peaks and grooves does not allow use of curled capsules, that is to say, having a curling in the end part of the side wall, in the embodiment of these caps.

The presence of the curling makes it possible to prevent the user from making contact with the sharp edge of the metal capsule, thereby reducing the risk of cutting when handling the closed bottle.

It follows that the user must pay particular attention when gripping a bottle closed with a crown cap.

The operation for closing a bottle with a crown cap also requires that the capping head acts at 360° in a radial fashion on the side wall.

This makes it necessary for the capping system to exert a force (or load) which is quite high so that each groove of the side wall adheres to the mouth of the bottle and an optimum seal is guaranteed.

The presence of forces which are so high results in an energy consumption of the capping system which is able to considerably affect the costs of the capping process, as well as causing greater damage in the case of malfunctions.

There is therefore a need which is felt particularly strongly by the producers of sparkling drinks or beers to have a capping head which is able to cap a bottle with a cap which guarantees the same seal and the same ease of opening as a crown cap, but which does not present a risk for the health of the user.

An aim of the invention is to provide a capping head which satisfies the above-mentioned need, guaranteeing in particular the possibility of capping in an effective, efficient and safe manner a bottle using a curled capsule.

A further need is that of providing a capping system which is more energy efficient, that is to say, in which the forces involved are not too high.

Another aim of the invention is to provide a capping system, comprising the above-mentioned capping head, the energy requirement of which is less than that of the prior art.

Yet another aim of the invention is to provide a capping system in which the forces applied on the cap during the capping are optimized.

A further aim of the invention is to illustrate a capping method which guarantees an optimum closing of a bottle containing pressurized liquids.

Said aims are fully achieved according to the invention as characterized in the appended claims.

BRIEF DESCRIPTION OF THE DRAWINGS

These and other features are more apparent from the following description of a preferred embodiment, illustrated by way of non-limiting example in the accompanying drawings, in which:

FIG. 1 is a perspective view of the capping head according to the invention;

FIG. 2 is a bottom view of the capping head of FIG. 1;

DESCRIPTION OF THE PREFERRED EMBODIMENTS

Figure 3:
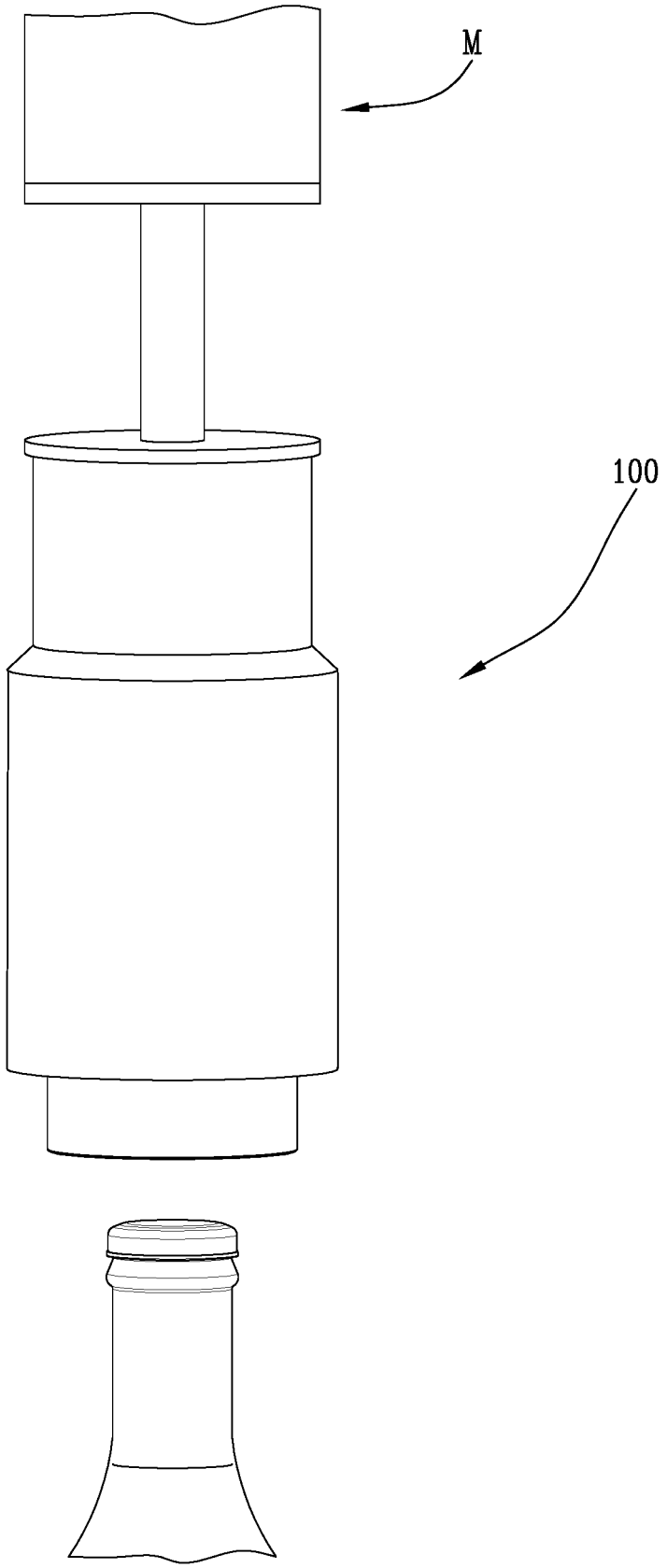
FIG. 3 is a perspective view of the capping system also according to the invention containing the capping head of FIG. 1 and a detail of the container with a cap not yet applied.

With reference to the accompanying drawings, the numeral 1 denotes a capping head designed to cap, by pressing, a container B by means of a cap T.

Preferably, the container B is a bottle.

Still more preferably, the container B is a glass bottle.

The cap T is made of metallic material, for example steel or aluminium.

Preferably, said cap T comprises a metal capsule and a plastic seal.

Still more preferably, the metal capsule of the cap T has a curling, that is to say, a curling in the end part of its side wall.

According to another aspect of the invention, the capping head 1 comprises a hollow main body 2 which extends about a longitudinal axis Z of the capping head 1.

Preferably, said longitudinal axis Z coincides, when the capping head is in operation, with a vertical axis, that is to say, an axis perpendicular to a horizontal plane on which the container B rests.

The main body 2 has, therefore, a lower opening 21 and an upper opening 22, positioned above the opening lower 21 relative to a direction of vertical extension V along the longitudinal axis Z.

In this description, unless further specified, the terms above and below refer to the position of an element along the longitudinal axis Z relative to the direction of vertical extension V (shown in the accompanying drawings).

The main body 2 preferably comprises metallic material, for example steel.

In a preferred embodiment illustrated in FIGS. 1 and 2, the main body 2 has the shape of a hollow cylinder.

When the main body 2 adopts three-dimensional shapes having a symmetry in their longitudinal extension, the longitudinal axis Z coincides with the longitudinal axis of symmetry.

Without limiting the scope of the invention, in other alternative embodiments, the main body 2 adopts hollow three-dimensional shapes.

As illustrated in FIG. 1, the main body 2 has a plurality of grooves 23 on at least a part of its extension along the longitudinal axis Z.

Said grooves 23 are, in effect, openings passing through the main body 2.

The grooves 23 extend along the main body 2 at least up to the lower opening 21, where a plurality of capping ends 3 is connected, in an integral fashion with the main body 2.

Preferably, said grooves 23 are made along the side wall of the main body 2.

The grooves 23 divide, at the lower opening 21 of the main body 2, said capping ends 3, that is, each capping end 3 is defined between a pair of adjacent grooves 23.

Preferably, said capping ends 3 consist of the same metallic material from which the main body 2 is made, for example steel.

Preferably, the number of capping ends 3 is between 12 and 28.

Still more preferably, the number of capping ends 3 is between 18 and 22.

Advantageously, the number of capping ends 3 represents a compromise between the quality of the seal of the cap T once applied to the container B and the ease of opening of the cap T.

An excessive number of capping heads 3 would cause a high-seal closure of the container B, but would adversely affect the gripping ease by means of bottle openers and therefore the ease of opening the cap T.

On the other hand, an insufficient number of capping heads 3 would result in an easy opening, without, however, guaranteeing the quality of the seal of the cap T applied to the container B (in particular in the presence of pressurized liquid).

Each of the capping ends 3 has a capping profile 4, 5 on its inner face, that is to say, on the face facing towards the inside of the main body 2 or, alternatively, facing towards the longitudinal axis Z.

As shown in FIG. 2, the capping profiles 4, 5 may be of two different types: concave capping profiles 4 and convex capping profiles 5.

The concave capping profiles 4 are types of capping profiles wherein, on the inner face of the capping end 3, the distance from the longitudinal axis Z increases from the points close to the groove 23 to the innermost points of the capping profile on the face of the capping end 3.

On the other hand, convex capping profiles 5 are types of capping profiles wherein, on the inner face of the capping end 3, the distance from the longitudinal axis Z decreases moving from the points close to the groove 23 to the innermost points of the capping profile on the face of the capping end 3.

In other words, the convex capping profiles 5 are like capping profiles which extend towards the inside of the capping head 1, that is, like crests (seen from the longitudinal axis Z).

On the other hand, the concave capping profiles 4 adopt the shape of grooves (seen from the longitudinal axis Z), where the innermost points have distances from the longitudinal axis Z greater than the outermost points of the capping profile.

In the embodiment shown in FIG. 2, the capping profiles 4, 5 have the shape of semi-circles projecting towards the inside of the capping head 1 in the case of a concave capping profile 4 and protruding towards the outside in the case of convex capping profiles 5.

In alternative embodiments, the capping profiles 4, 5 have circular shapes which cover arcs with a circumference greater than or less than 180°.

In yet other embodiments, the capping profiles 4, 5 have polygonal shapes, for example triangular or trapezoidal.

Forms of hybrid embodiments are also provided, in which broken lines alternate with curved shapes, both circular and elliptical.

According to an aspect of the invention, at least one pair of capping ends 3 has a change in the type of capping profile, that is to say, one has a concave capping profile 4 and the other has a convex capping profile 5.

In that way, at least one pair of adjacent capping ends 3 has a change in the capping profile 4, 5.

According to the embodiment shown in FIGS. 1 and 2, each pair of adjacent capping ends 3 has a concave capping profile 4 and a convex capping profile 5.

In other words, there is an alternation 1-1 between the concave and convex capping profiles and, according to the above-mentioned embodiment, there is an alternation along the circumferential direction of the capping head 1, of concave and convex capping profiles.

In other embodiments not illustrated, the distribution of the capping profiles on the capping heads is irregular (that is to say, without a constant alternation between the capping profiles on the capping ends) or regular with a law of alternation between the types of capping profiles different from that shown in FIGS. 1 and 2.

According to another aspect of the invention, the capping head 1 comprises a capping ring 6, operatively connected to the main body 2 and the capping ends 3.

The capping ring 6 is positioned outside the main body 2 and is connected in a movable fashion to the main body.

In particular, the capping ring 6 is movable translationally along the longitudinal axis Z.

Preferably, the main body 2 has a cylindrical shape and the capping ring 6 has an inner circumference greater than the outer circumference of the main body 2.

This dimensional difference between the circumferences of the main body 2 and the capping ring 6 allows the translational movement of the capping ring 6 along the main body 2 not to be obstructed.

Preferably, as illustrated in FIGS. 1 and 2, the capping ends 3 extend outwards, that is to say, their outer face moves away from the longitudinal axis Z as it moves down along the longitudinal axis Z in the opposite direction to the direction of vertical extension V.

In particular, at the capping ends 3 the inner circumference of the capping ring 6 is less than the outer circumference constituted by the outer faces of the capping end 3.

The translation of the capping ring 6 is obstructed below by the presence of the capping ends 3 and therefore the capping ring 6 comes into contact with the outer face of the capping ends 3 when it is at the capping ends at the lower end of the main body 2.

The contact of the capping ring 6 with the outer face of the capping ends 3 determines a deformation in the elastic range of the capping ends, in a radial direction towards the longitudinal axis Z.

Preferably, the capping ring consists of polytetrafluoroethylene, a polymer also known as Teflon© or Algoflon©.

Advantageously, the use of polytetrafluoroethylene guarantees a very reduced friction coefficient and allows an easy sliding of the capping ring 6 along the main body 2, even when the inner diameter of the ring is almost equal to the outer diameter of the main body.

Advantageously, the capping head 1 described makes it possible to cap a container in an effective, efficient and safe manner with a cap having a curling.

Figure 4:
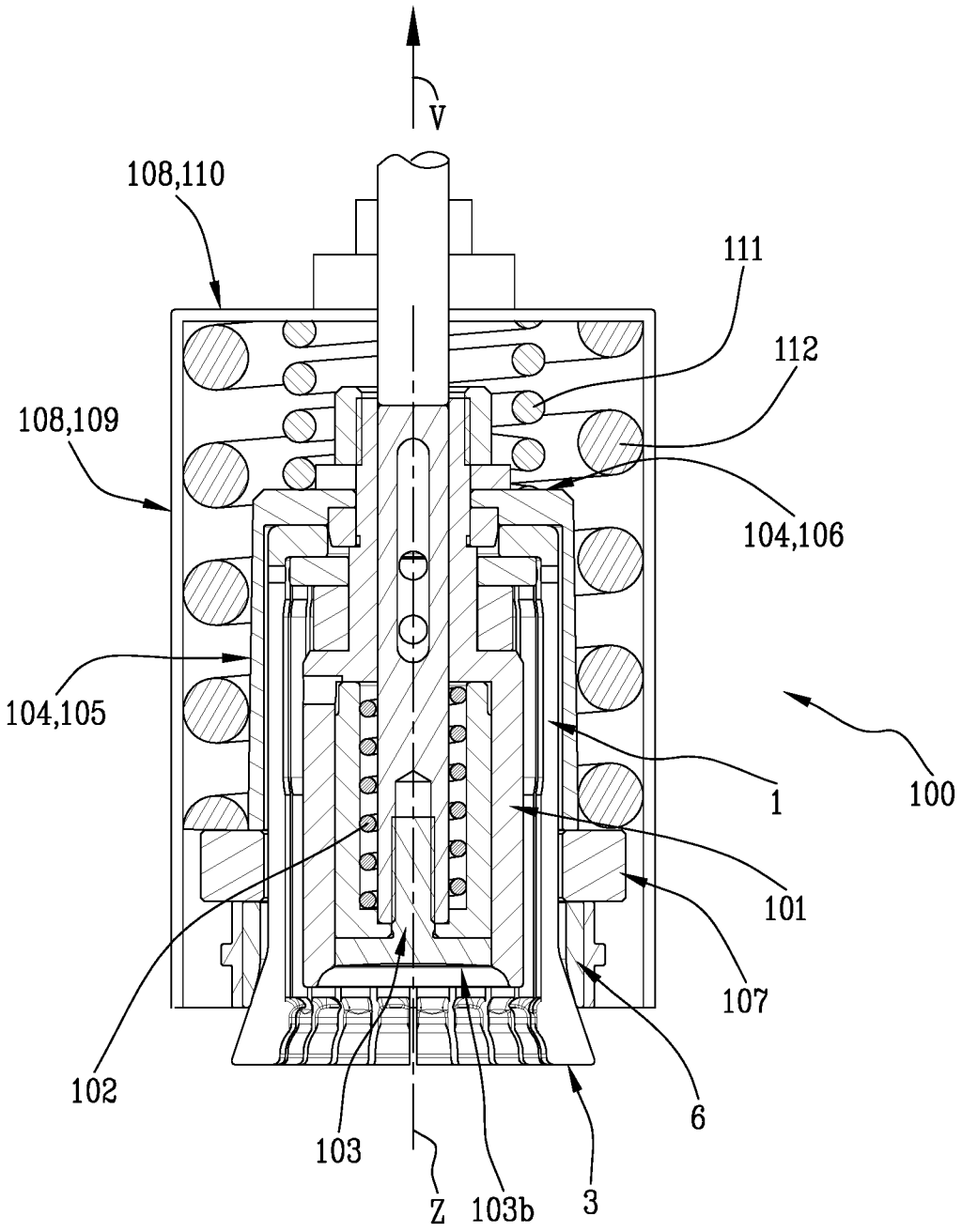
FIG. 4 is a front cross section of the capping system of FIG. 3 through a plane A-A.

The invention also defines a capping system 100, shown in FIGS. 3 and 4 and comprising the capping head 1 described above.

As shown in the cross-section of FIG. 4, the capping system comprises a device 101 for retaining the cap T on a neck C of the container B.

Said retaining device 101 is entirely contained inside the capping head 1 and occupies almost entirely the cavity inside the main body 2 of the capping head 1.

The retaining device 101 comprises a first spring 102 and a first contact piston 103, operatively connected to each other.

In particular, the first piston 103 is movable along the longitudinal axis Z of the capping head 1 between a lower end position and an upper end position.

In its lower end position, the first contact piston 103 has a relative lower face 103*b* positioned below the lower opening 21 of the main body 2.

In this lower end position of the first piston 103, the first spring 102 is in its maximum extension situation.

In its upper end position, shown in FIG. 4, the first contact piston 103 has a relative contact face 103*b* positioned at a height substantially equal to the lower opening 21 of the main body 2.

In this upper end position of the first piston 103, the first spring 102 is in the situation of maximum possible compression.

Said first contact piston 103 is configured to keep the cap T in position during the capping operations.

In effect, the insertion of the cap T below the capping head 1, causes, following contact between the first piston 103 and the upper outer face of the cap T, the raising of the first piston 103, which moves to its upper end position.

Here the return force of the first spring 102 means that the first piston 103, by means of its contact face 103*b*, exerts a pressure on the cap T, which therefore remains secure in its position on the neck C of the container B during the capping.

Advantageously, the presence of the retaining device 101 makes it possible to reduce the risk that the cap T moves during the capping operations and, consequently, reduces the risk of a defective closing of the container B.

According to another aspect, the capping system 100 comprises an inner casing 104, containing inside it at least a part of the capping head 1.

Preferably, said inner casing 104 is made of metallic material, for example steel.

Said inner casing 104 comprises a lateral surface 105 and an upper surface 106, extending in a direction transversal to the longitudinal axis Z of the capping head 1.

Preferably, said inner casing 104 has the shape of a cylinder open on one of its two flat faces.

According to one aspect of this invention, the capping system 100 comprises a contact ring 107.

Said contact ring 107 is positioned below the inner casing 104 along the longitudinal axis Z in relation to the direction of vertical extension V.

The contact ring 107 extends in a circular direction in a plane almost perpendicular to the longitudinal axis Z.

Preferably, in use, the contact ring 107 has a circular axis of symmetry substantially coinciding with the longitudinal axis Z.

In particular, the outside diameter of the contact ring 107 is greater than the outside diameter of the inner casing 104, when the latter is cylindrical in shape.

In other words, in use, the contact ring 107 extends radially relative to the inner casing 104, as shown in FIG. 4, also acting as a support for the inner casing 104.

In particular, the capping ring 6 located below the contact ring 107 substantially close to the capping ends 3.

Again as illustrated in FIG. 4, the capping system 100 comprises an outer casing 108, containing the inner casing 104.

According to one aspect of the invention, the inner casing 104 is movable along the longitudinal axis Z inside the outer casing 108.

Preferably, said outer casing 108 is made of a metallic material, for example steel.

Said outer casing 108 comprises an outer surface 109 (lateral) and a contact surface 110 (upper) extending in a direction transversal to the longitudinal axis Z of the capping head 1.

Preferably, said outer casing 108 has the shape of a cylinder open (below) on one of its two flat faces.

The capping system 100 then comprises a second spring 111, contained inside the outer casing 108 outside the inner casing 104.

Said second spring 111 is interposed and acts between the upper surface 106 and the contact surface 110, respectively, of the inner casing 104 and of the outer casing 108.

Preferably, said second spring 111 is made of a metallic material, for example spring steel.

The capping system 100 further comprises a third spring 112, contained inside the outer casing 108 outside the inner casing 104.

Said third spring 112 is interposed and acts between the contact surface 110 of the outer casing 108 and the contact ring 107.

Preferably, said third spring 112 is made of metallic material, for example spring steel.

Preferably, said third spring 112 extends inside the outer casing 108 along the longitudinal axis Z for a length of between 80 mm and 100 mm.

Still more preferably, said third spring 112 extends inside the outer casing 108 along the longitudinal axis Z for a length of between 85 mm and 95 mm.

This length is to be understood with reference to the third spring 112 under rest conditions, that is to say, under conditions in which no load or extension force is applied on the third spring.

The aim of said first and second springs 111, 112 is to oppose the movement along the longitudinal axis Z of the inner casing 104 and of the contact ring 107 inside the outer casing 108, in particular to oppose the raising movement of the inner casing 104 and of the contact ring 107 inside the outer casing 108.

According to another aspect, the capping system 100 comprises an actuator M, of substantially known type, operatively connected with the outer casing 108 (for moving the latter).

It should be noted that the actuator M moves during use in a substantially vertical manner only the outer casing 108: the particular configuration of the capping system 100 means that, when the capping ends 3 make contact with the cap of the bottle, further elements of the capping system 100 are moved relative to the outer casing 108, as described in more detail in the rest of the description.

Said actuator M is positioned above the outer casing 108 and is configured to apply a force along the longitudinal axis Z in the opposite direction relative to the direction of vertical extension V.

Advantageously, the capping system 100 described makes it possible to apply the cap T to the container B, preferably a glass bottle, in such a way as to obtain a closure with an optimum seal and easy opening.

The invention also defines a capping method for closing a container B using a cap T comprising the steps described below.

Firstly, a step of preparing a capping head 1 such as that described above.

Subsequently, the capping method comprises a step of positioning the cap T on the neck C of the container, in such a way that a side wall of the cap T is positioned outside around the cap T of the container B.

The method then comprises a step of preparing the container B below the capping head 1 in the direction of vertical extension V along the longitudinal axis Z of said capping head 1.

There is also a step of moving the capping ring 6 along the longitudinal axis Z, in such a way as to elastically deform the capping ends 3.

Lastly, the capping method comprises a step of radial plastic deforming of the cap T, by means of the capping ends 3, and closing, by means of the cap T, the container B.

It should be noted that, preferably, the step of plastic deformation of the cap T occurs only in a radial direction.

It should be noted that, during the latter step, the capping ends 3 make contact with the side wall of the cap T, causing the deformation (in a radial direction), that is to say, a partial narrowing at the side wall of the cap T.

Below is a detailed description of the capping sequence of a container B with a cap T using the capping system 110 according to the invention, by way of a non-limiting example.

The first step comprises preparing the cap T around the neck C of the container B, that is to say, with the side wall of the cap T positioned around the neck C of the container B.

The container B, with the cap T suitably prepared, is positioned below the capping system 100, that is to say, in a position lower than the direction of vertical extension V along the longitudinal axis Z.

In particular, this position is aligned along the longitudinal axis Z, that is, vertically, with the capping head 1 and with the retaining device 101.

Subsequently, the capping sequence comprises actuating the actuator M, which causes the translation downwards of the capping system 100 along the longitudinal axis Z (in the opposite direction to the direction of vertical extension V).

During the translation of the capping system 100, firstly the first piston 103 comes into contact, by means of the contact surface 103*b*, with the cap T and the first piston 103 translates, relative to the capping head 1, upwards (that is, towards the inside of the capping head 1) along the longitudinal axis Z, maintaining the contact with the cap T.

Consequently, the first spring 102 applies a return force which opposes the raising of the first piston 103, which in turn exerts the thrust on the cap T preventing the latter from moving during the capping operations.

By translating further downwards along the longitudinal axis Z, the capping system 100 encounters the resistance of the container B and the capping head 1, being movable inside the outer casing 108 together with the inner casing 104, the contact ring 107 and the retaining device 101, substantially stop its translation downwards.

At the same time, the outer casing 108 continues its translation downwards along the longitudinal axis Z and, therefore, said second spring 111 and third spring 112, acting between the outer casing 108 and, respectively, the inner casing 104 and the contact ring 107, are compressed.

In particular, the third spring 112, being operatively active between the contact surface 110 and the contact ring 107, applies an elastic return force which translates into a downward thrust of the contact ring 107.

This thrust is transferred to the capping ring 6, which comes into contact with the bottom of the contact ring 107.

Under the action of this force, the capping ring 6 (which has high sliding properties thanks to the materials from which it is made) translates downwards, being interposed between the capping ends 3 and the outer casing 108.

However, close to the capping ends 3, the outer circumference is greater than that of the capping ring 6, which applies a radial pressure towards the inside, which causes the narrowing of the grooves 23 and therefore the moving of the capping heads 3 to the longitudinal axis Z.

Figure 5:
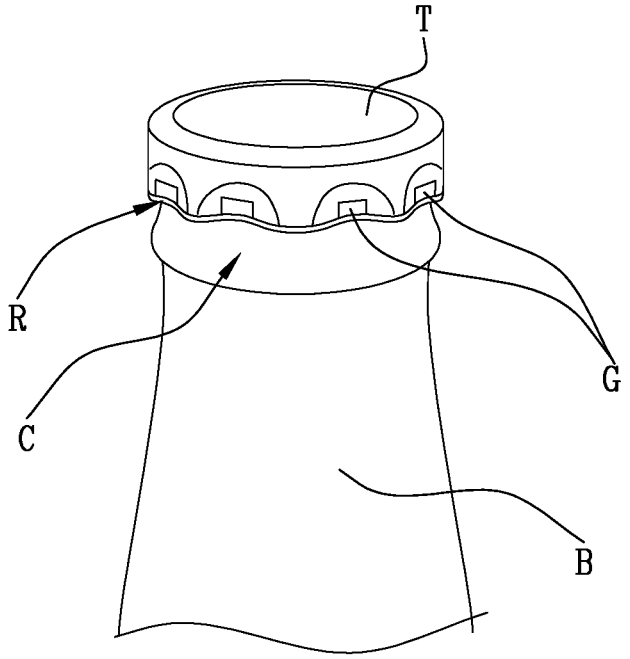
FIG. 5 is a perspective view of the cap applied to the container in the shape adopted after it has been applied to the container by the capping head and by the capping system according to the invention.

In this way, the capping heads 3 make contact with the cap T, which is radially deformed in a plastic fashion as shown in FIG. 5.

Grooves G are created at the convex capping profiles 5 on the side wall of the cap T which carry the cap T into contact with the neck C of the container B; areas which protrude radially outwards are left on the side wall of the cap T at the convex capping profiles 4.

It should be noted, therefore, that the capping heads 3 with a concave and convex profile operate in perfect synergy to allow the cap T to be closed, making the desired radial plastic deformations.

As may be noted in FIG. 5, the cap T deformed in this way has a curl R, that is to say, a curling in the end part of the side wall, which remains intact even after the action of the capping heads 3.

In other words, the plastic deformation caused by the capping heads 3 does not affect the curling R.

Advantageously, the presence of the curling makes it possible to reduce the risks for the safety of a user handling the container B closed by the cap T.

Once the plastic deformation of the cap P has been completed through the capping ends 3, the second spring 111 also comes into operation, which obstructs the action of the actuator M and prevents a further translation of the entire capping system 100 damaging the container B.

Lastly, the actuator M reverses the translating motion and causes the raising of the capping system 100.

Preferably, said actuator M is of the mechanical type comprising, for example, a cam mechanism which allows the lowering and raising movements of the capping system 100.

Figure 6:
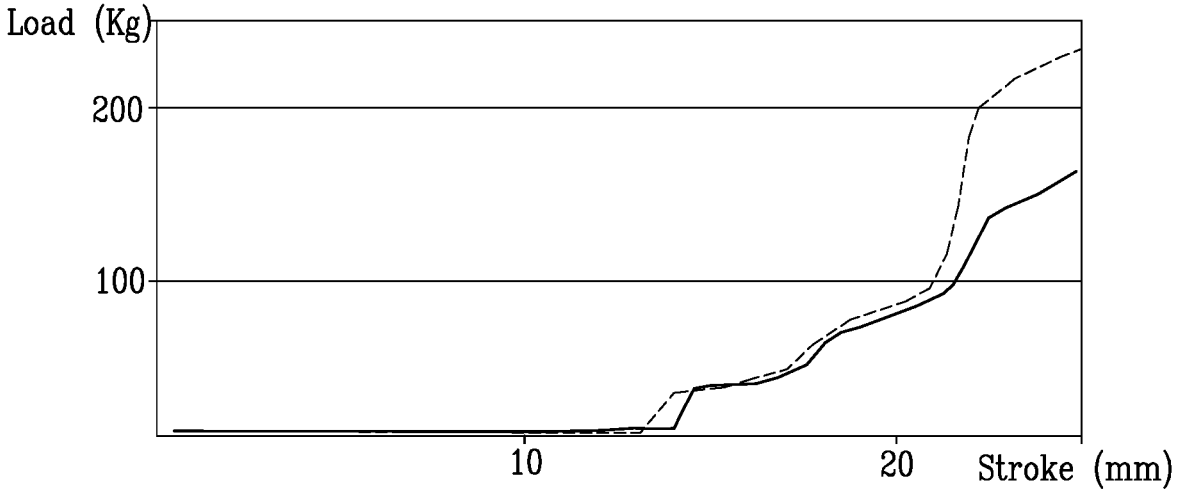
FIG. 6 shows a comparative graph of the compression-loading curves of the capping system according to the invention and of a traditional capping system.

FIG. 6 shows the benefits provided by a suitable sizing of said second and third springs 111, 112 inside the capping system 100.

This diagram shows the translation-loading curves for two capping systems comprising the capping head 1 according to the invention.

The continuous line represents the translation-loading curve of a capping system comprising a third spring 112 with a length (in rest conditions) of 91 mm, whilst the dashed line represents the translation-loading curve of a capping system comprising a third spring 112 with a length (in rest conditions) of 105 mm, typically used in the prior art capping systems.

Advantageously, a shorter length of the third spring 112 allows the capping system 100 to obtain the same capping effects with axial capping loads less than approximately 100 kg.

In that way, the capping system 100 is more energy efficient than traditional systems, whilst maintaining unchanged the quality of the closing of the container B.

What is claimed is:

1. A capping head for closing a container using a metallic cap, comprising:

a hollow main body which extends around and along a longitudinal axis of the capping head;

a plurality of capping ends, integral with the main body and positioned below the main body in an axial direction along the longitudinal axis, each of the capping ends, having a capping profile on an inner face thereof facing towards the longitudinal axis;

a capping ring, positioned outside the main body, movable along the longitudinal axis relative to the capping ends and configured for elastically deforming the plurality of capping ends through the relative movement along the longitudinal axis;

wherein each adjacent pair of the capping ends includes one capping end having a predominately concave capping profile as viewed in the axial direction and another capping end having a predominately convex capping profile as viewed in the axial direction, thereby defining a circumferential alternation around the capping head of the predominately concave capping profile and the predominately convex capping profile.

2. The capping head according to claim 1, wherein the plurality of capping ends includes between 12 and 28 capping ends.

3. The capping head according to claim 1, wherein the plurality of capping ends includes between 18 and 22 capping ends.

4. The capping head according to claim 1, wherein the capping ring is made of polytetrafluoroethylene.

5. The capping head according to claim 1, wherein at least one chosen from the predominately concave capping profile and the predominately convex capping profile is shaped as a circular arc.

6. The capping head according to claim 1, wherein the hollow main body is shaped as a hollow cylinder.

7. A capping system for closing a container using a metallic cap comprising:

the capping head according to claim 1;

a device for retaining the cap on a neck of the container, positioned inside the capping head and comprising a first spring operatively connected to a first contact piston configured to contact the cap and movable along the longitudinal axis of the capping head;

an inner casing configured to contain in an interior thereof at least a part of the capping head, comprising a lateral surface, and an upper surface extending in a direction transversal to the longitudinal axis of the capping head;

a contact ring, positioned below the inner casing along the longitudinal axis in the axial direction and configured to contain in an interior thereof at least a part of the capping head;

an outer casing, comprising an outer surface and a contact surface extending in a direction transversal to the longitudinal axis of the capping head, configured to contain in an interior thereof the inner casing and the contact ring;

a second spring, contained inside the outer casing and outside the inner casing, interposed between the upper surface and the contact surface and acting between the upper surface and the contact surface;

a third spring, contained inside the outer casing and outside the inner casing, interposed between the contact surface and the contact ring and acting between the contact surface and the contact ring;

an actuator operatively connected to the outer casing for moving, and exerting a downward force on, said outer casing in the axial direction.

8. The capping system according to claim 7, wherein the third spring extends inside the outer casing along the longitudinal axis, externally in a radial direction relative to the second spring.

9. The capping system according to claim 7, wherein the third spring extends inside the outer casing along the longitudinal axis for a length of between 80 mm and 100 mm.

10. The capping system according to claim 7, wherein the third spring extends inside the outer casing along the longitudinal axis for a length of between 85 mm and 95 mm.

11. A capping method for closing a container using a cap comprising the steps of:

providing a capping head comprising:

a hollow main body which extends around and along a longitudinal axis of the capping head;

a plurality of capping ends, integral with the main body and positioned below the main body in an axial direction along the longitudinal axis, each of the capping ends, having a capping profile on an inner face thereof facing towards the longitudinal axis;

a capping ring, positioned outside the main body, movable along the longitudinal axis relative to the capping ends and configured for elastically deforming the plurality of capping ends through the relative movement along the longitudinal axis;

wherein each adjacent pair of the capping ends includes one capping end having a predominately concave capping profile as viewed in the axial direction and another capping end having a predominately convex capping profile as viewed in the axial direction, thereby defining a circumferential alternation around the capping head of the predominately concave capping profile and the predominately convex capping profile;

positioning the cap with a relative side wall positioned around a neck of the container;

positioning the container below the capping head in the axial direction and along the longitudinal axis;

positioning the capping head above the container with the capping ends positioned around the cap;

moving the capping ring downward along the longitudinal axis for elastically deforming the capping ends radially inward to plastically deform the cap with the capping ends, thereby sealing the cap on the container.

* * * * *